US007981016B1

(12) United States Patent
Howard

(10) Patent No.: US 7,981,016 B1
(45) Date of Patent: Jul. 19, 2011

(54) CORE STRENGTHENING DEVICE AND METHOD FOR STRENGTHENING USING THE SAME

(76) Inventor: Kipland Howard, San Diego, CA (US)

( * ) Notice: Subject to any disclaimer, the term of this patent is extended or adjusted under 35 U.S.C. 154(b) by 0 days.

(21) Appl. No.: 12/652,716

(22) Filed: Jan. 5, 2010

(51) Int. Cl.
*A63B 26/00* (2006.01)

(52) U.S. Cl. ..... 482/141

(58) Field of Classification Search ..... 482/141, 482/62, 34, 44, 51, 91, 907, 148, 139, 92, 482/132, 126; D21/662, 665
See application file for complete search history.

(56) References Cited

U.S. PATENT DOCUMENTS

| | | | | |
|---|---|---|---|---|
| 1,824,920 | A * | 9/1931 | Novak | 482/132 |
| 2,590,951 | A * | 4/1952 | Farison | 482/126 |
| 2,819,081 | A * | 1/1958 | Touraine | 482/45 |
| 3,622,152 | A * | 11/1971 | Place | 482/132 |
| 3,784,192 | A * | 1/1974 | Nutter | 482/132 |
| 3,796,431 | A * | 3/1974 | Sinyard | 482/132 |
| 4,610,448 | A * | 9/1986 | Hill | 482/141 |
| 4,700,945 | A * | 10/1987 | Rader | 482/132 |
| 4,892,305 | A * | 1/1990 | Lynch | 482/132 |
| 5,358,463 | A * | 10/1994 | Fuentes | 482/141 |
| 5,632,707 | A * | 5/1997 | Daniel et al. | 482/8 |
| 6,761,672 | B1 * | 7/2004 | Williams | 482/132 |
| 6,773,379 | B1 * | 8/2004 | Bing | 482/132 |
| 6,942,605 | B1 * | 9/2005 | Sukhovitsky | 482/132 |
| 7,553,267 | B1 * | 6/2009 | Hauser et al. | 482/141 |
| 7,585,262 | B1 * | 9/2009 | Vayntraub | 482/141 |
| 7,621,858 | B2 * | 11/2009 | Sheron | 482/132 |
| 2005/0245372 | A1 * | 11/2005 | Mylrea et al. | 482/148 |
| 2006/0035771 | A1 * | 2/2006 | Gant | 482/141 |
| 2007/0049473 | A1 * | 3/2007 | Chapman et al. | 482/121 |
| 2009/0298656 | A1 * | 12/2009 | Dannenberg | 482/141 |
| 2009/0305853 | A1 * | 12/2009 | Jordan | 482/132 |
| 2010/0004105 | A1 * | 1/2010 | Peddar | 482/132 |
| 2010/0130337 | A1 * | 5/2010 | Stewart | 482/121 |
| 2010/0210430 | A1 * | 8/2010 | Mulderrig et al. | 482/141 |

* cited by examiner

*Primary Examiner* — Lori Baker
(74) *Attorney, Agent, or Firm* — Mintz, Levin, Cohn, Ferris, Glovsky and Popeo P.C.

(57) ABSTRACT

The core strengthening device includes a base having a first base section and a second base section. Each of the first and second base sections includes a connection mechanism with which to connect together to form a unitary device. The connection mechanism is detachable to separate the first and second base sections to form a two-part device. The device further includes a handle connected to a top surface of each of the first and second base sections. The device further includes two or more load-bearing rolling devices such as ball transfers or casters connected to a bottom surface of each of the first and second base sections to enable smooth movement over a surface by a user via the handles of the first and second base sections, either as the unitary device or independently as the two-part device.

12 Claims, 11 Drawing Sheets

CORE STRENGTHENING DEVICE AND METHOD FOR STRENGTHENING USING THE SAME

BACKGROUND

The present invention is directed to exercise equipment, and more particularly to a core strengthening device, and method for using the same.

Core strengthening and development equipment and techniques are popular with modern exercise regiments. The "core" relates to the deep and superficial muscles that stabilize, align and move the trunk of the body, especially the upper and lower abdominal muscles and muscles of the back. A well-developed core is important for a person's overall health, stability, strength and feeling of well-being. The core is also directly interconnected with, and can have a beneficial effect on, other muscle groups such as the arms, chest, legs and the gluteal muscles.

Core strengthening devices can be moved by user over a surface to leverage the core's muscles as resistance against the movement, thereby firing those muscles and developing the core. However, conventional core strengthening devices exist as a unitary device which limits movement by user, and therefore limits the range of development of the core muscles.

SUMMARY

This document presents a core strengthening device and method for using the same.

In one aspect, a core strengthening device includes a base having a first base section and a second base section. Each of the first and second base sections includes a connection mechanism with which to connect together to form a unitary device. The connection mechanism is detachable to separate the first and second base sections to form a two-part device. The device further includes a handle connected to a top surface of each of the first and second base sections. The device further includes two or more load-bearing rolling devices such as ball transfers or casters connected to a bottom surface of each of the first and second base sections to enable smooth movement over a surface by a user via the handles of the first and second base sections, either as the unitary device or independently as the two-part device. In some implementations, each of the first and second base sections includes three ball transfers or casters.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

This document describes a core strengthening device and method for using the same. The "core" relates to the deep and superficial muscles that stabilize, align and move the trunk of the body, especially the upper and lower abdominal muscles and muscles of the back.

In an exemplary implementation, a core strengthening device includes a base having a first base section and a second base section. The first and second base sections each have a connection mechanism with which to connect together to form a unitary base, and the connection mechanism is detachable to separate the first and second base sections to create two independently movable base sections. The top surface of each of the first and second base section includes a handle, for either independent or cooperative manipulation of the device as separate base sections or as a unitary base, respectively. The device further includes three or more ball transfers connected to a bottom surface of each of the first and second base sections to enable stability on, and smooth movement over, a surface of the first and second base sections.

Figure 1A:
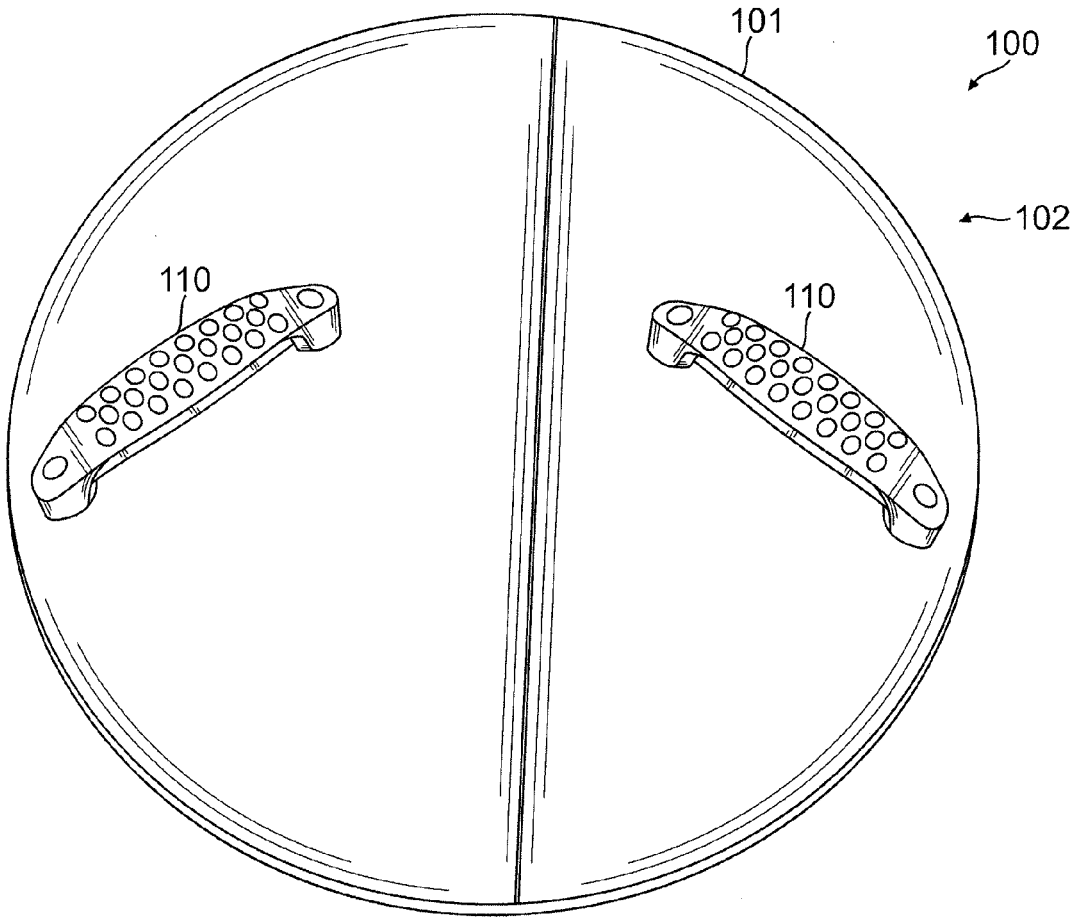
FIGS. 1A-1D illustrate various views of a core strengthening device.
Figure 1B:
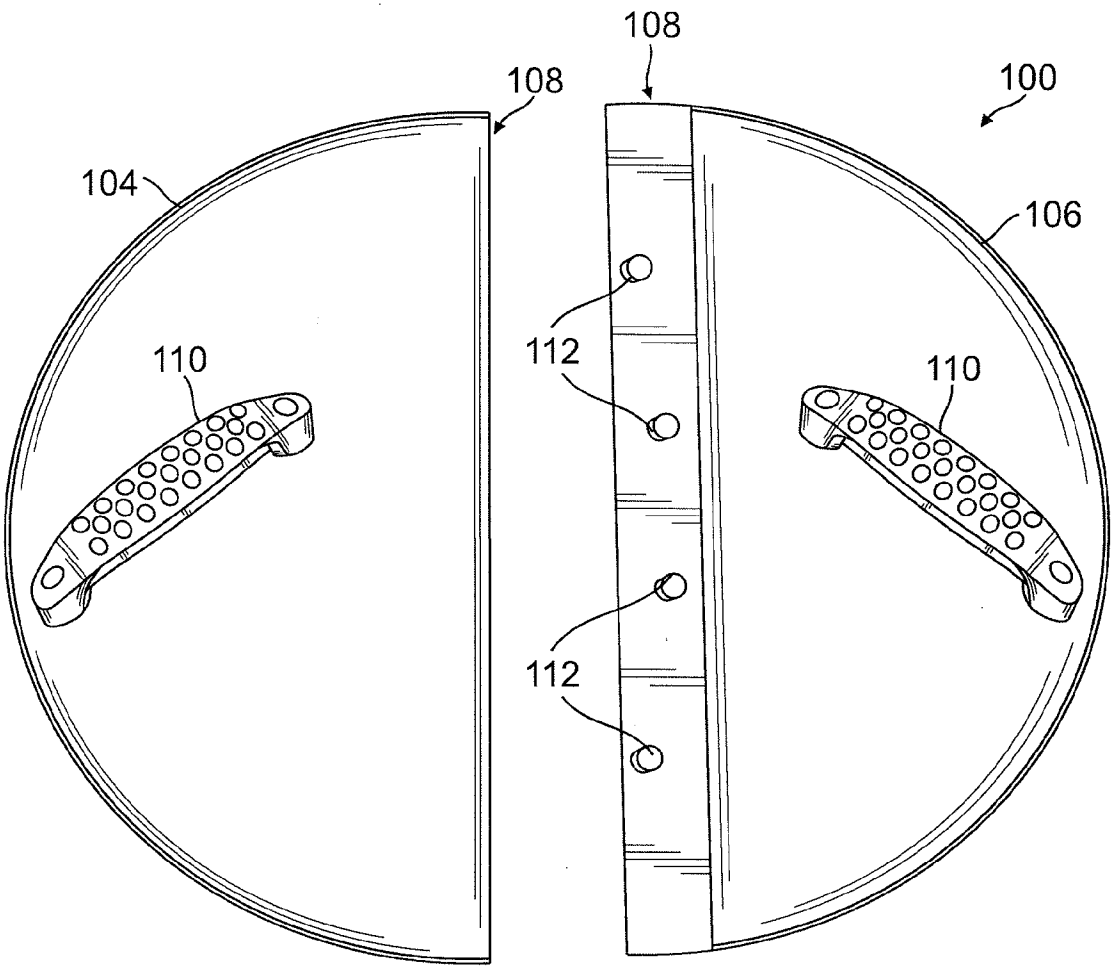
Figure 1C:
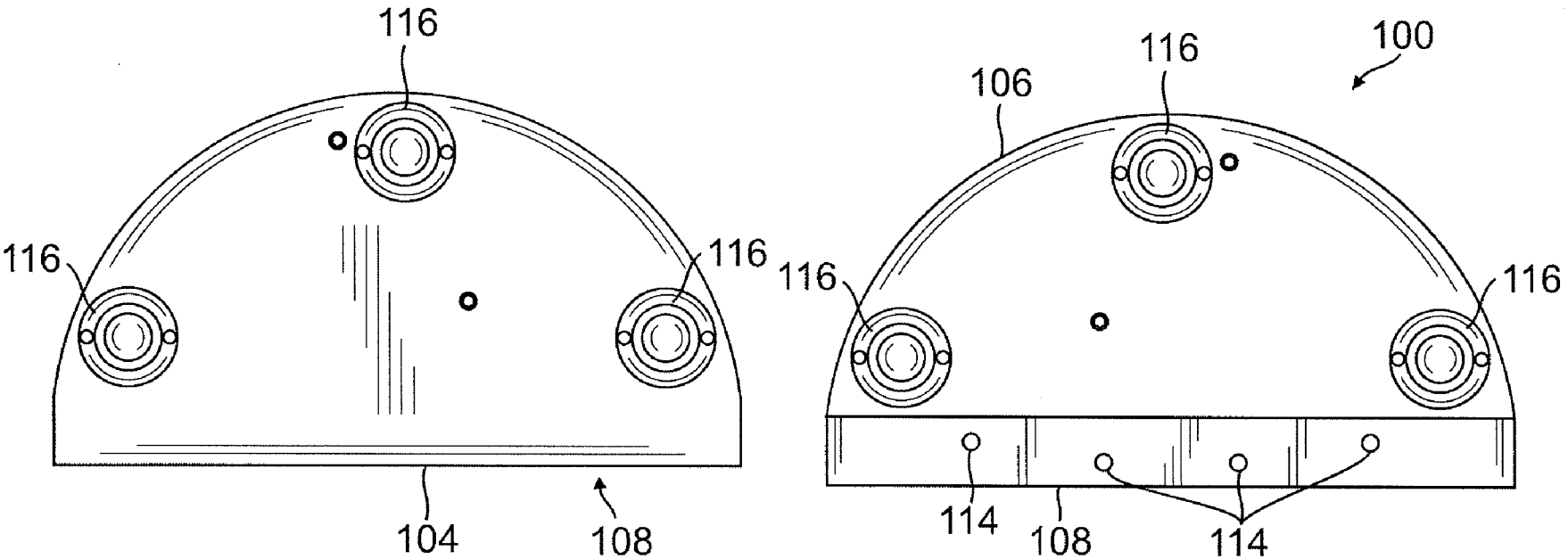
Figure 1D:
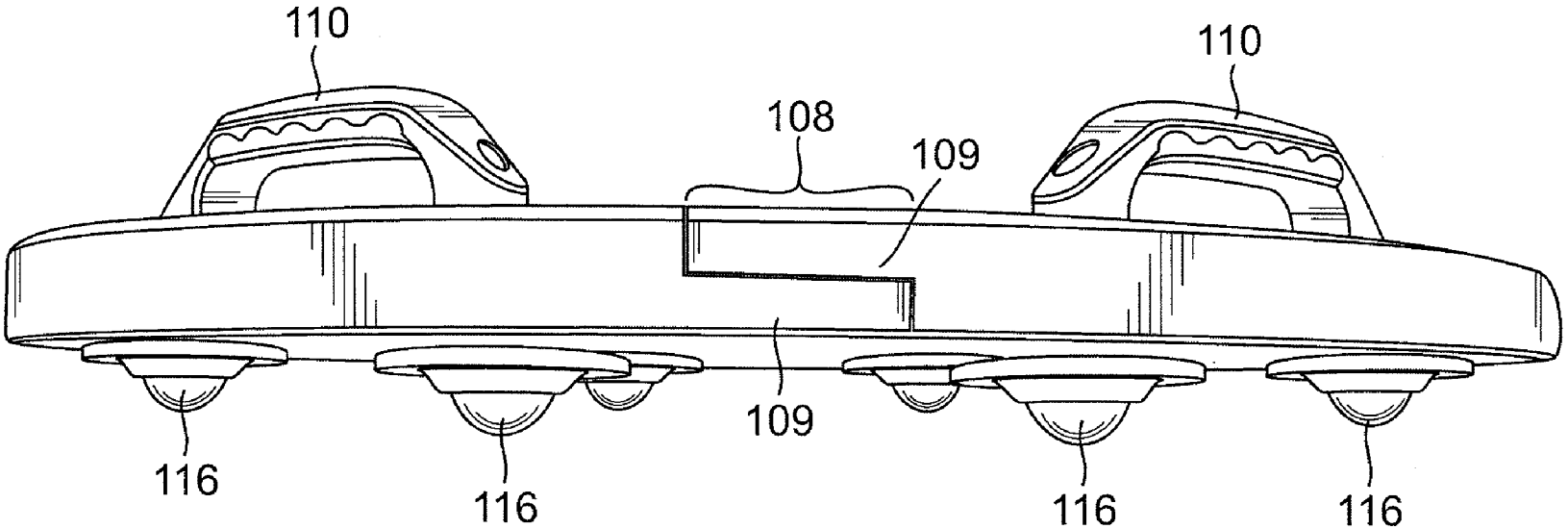

FIGS. 1A-1C show a top view of a device 100 with a unitary base 102, a top view of the device 100 as separate base sections 104, 106, and a bottom view of the device 100 as separate base sections 104, 106, respectively. FIG. 1D is a side view of the device 100 to illustrate the separate base sections 104, 106 being connected by their respective connection mechanisms 108. Referring specifically to FIGS. 1A and 1B, the device 100 includes a base 101 that is provided as a first base section 104 and a second base section 106 as separate base sections that connect together via a connection mechanism 108 to form the unitary base 102.

The unitary base 102 is preferably circular, but can be squared or polygonal. The first base section 104 and second base section 106 are preferably half-circles of substantially equal size (except possibly for their connection mechanism, for example, as will be discussed further below). The base 101 can be formed of wood, plastic, polyvinyl carbonate or other synthetic material, carbon fiber, metal or any other rigid material. The first base section 104 and second base section 106 each include a handle 110 disposed on the top surface of the base 101. Each handle 110 preferably includes a soft, resilient outer layer to provide a gripping surface for a user. The soft outer layer may be formed with additional gripping bumps or grooves, or other traction mechanisms. The handles 110 can also be angled from 20-70 degrees from a diameter axis that is normal to the line of connection between the first base section 104 and second base section 106 of the base 101. This angle can be adjustable in some implementations, to provide the user a customizable orientation of the handle for comfort.

In some alternative implementations, in place of the handles 110, the top surface of each of the first and second base sections 104 and 106 can include a surface region, an indentation, or a glove-like structure for receiving a palm and/or fingers of a user, to enable the user to use the device with their palms flat on the first base section 104 and/or second base section 106. In this alternative, the fingers, palm and various muscles of the forearm are worked and exercised than with the handle. In yet another alternative, the handles 110 themselves may extend above the top surface of each of the first and second base sections 104 and 106 and define a fitted opening into which at least a portion of a user's hand can be positioned, preferably palm-down and flat against the top surface of the first and second base sections 104 and 106. The fitted opening defined by each handle 110 can hold the at least portion of the user's hand in place as the user operates the device 100.

As shown with particularity in FIGS. 1B, 1C, and 1D, exemplary implementations of the connection mechanism 108 includes juxtaposing edge regions 109 on each of the first base section 104 and second base section 106. The edge regions 109 of one of the first base section 104 or second base section 106 can include connecting rods 112 that extend up from the edge region 109, while the other base section can include correspondingly placed receptacles 114 that are sized and adapted to fixedly receive a corresponding connecting rod 112. The connecting rods 112 have a height, and the receptacles 114 have a depth, that ensure a rigid connection between the first base section 104 and second base section 106 when connected as a unitary base 102 (as shown in FIG. 1D), yet are easily detachable to provide the first base section 104 and second base section 106 as separate base sections. The connecting rods are preferably not aligned, i.e. arranged non-linearly, thereby eliminating a major amount of torque or twisting on each of the base sections.

The device 100 further includes a number of ball transfers 116 connected to a bottom surface of each of the first and second base sections 104, 106. Example ball transfers 116 that are suitable for use with the device include all-steel "flying saucer" type ball transfers manufactured by Hudson Bearings, Inc., of East Lyme, Conn. The ball transfers 116 can be made of carbon steel, nylon, stainless steel, ceramic or carbon fiber material.

In exemplary implementations, each of the first base section 104 and second base section 106 include three ball transfers 116 to provide stability and enable smooth movement over a surface by a user via the handles 110 of the first and second base sections 104, 106, either as the unitary base or independently as the two-part base. The total of six ball transfers 116 of the device 100 can be spaced evenly about the bottom surface of the base 101 in the unitary base configuration, yet provide three contact points for each of the first base section 104 and second base section 106 in the two-part base configuration. In other implementations, two ball transfers 116 can be used for each of the first base section 104 and second base section 106, to provide instability in the two-part base configuration (to develop balance), yet still provide stability in the unitary base configuration.

The term "ball transfers" relates to any device that includes a rolling, load-bearing ball which abuts other smaller balls inside a hemispherical cup, which is typically case-hardened steel. In place of the ball transfers 116, the device 100 may also include casters, i.e. any of a set of wheels or rotating balls mounted in a swivel frame. The casters can include wheels or balls formed of polyurethane, rubber, porcelain, hardwood, nylon, steel, carbon fiber, or combination thereof. The wheels or balls of the casters typically have center bearings that can be made of steel, ceramic, or titanium. In some implementations, the casters can be "locking" casters in which the wheels or balls can be locked into an unmovable position, thereby rendering the device 100 as a suitable push-up platform or platform for other types of exercises.

Figure 2:
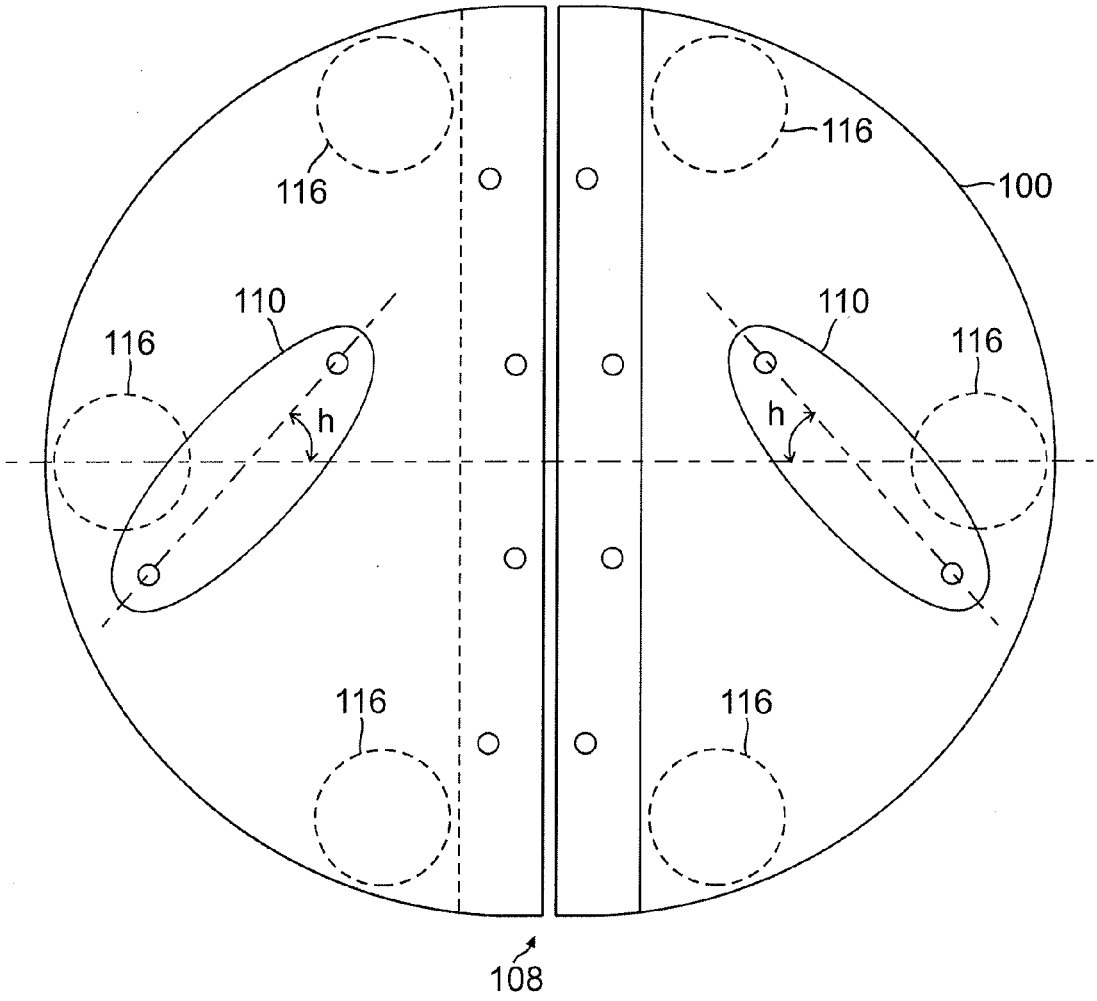
FIG. 2 illustrates positioning and arrangement of the handles and ball transfers for an exemplary implementation of the core strengthening device.

FIG. 2 illustrates an example positioning and arrangement of the handles 110 and ball transfers 116 for the exemplary implementation of the core strengthening device 100. The handles 110 can be arranged at an angle h from an axis that is perpendicular to the axis of the connection mechanism 108, where h is an angle between 20-70 degrees. The angle h can also be less than 20 degrees and greater than 70 degrees. In other implementations, the angle h is adjustable to any angle. The ball transfers 116 are equally spaced at least on the bottom surface of both the first base section 104 and the second base section 106, but need not necessarily be spaced on the bottom surface of the base 101 in the unitary base configuration.

Figure 3:
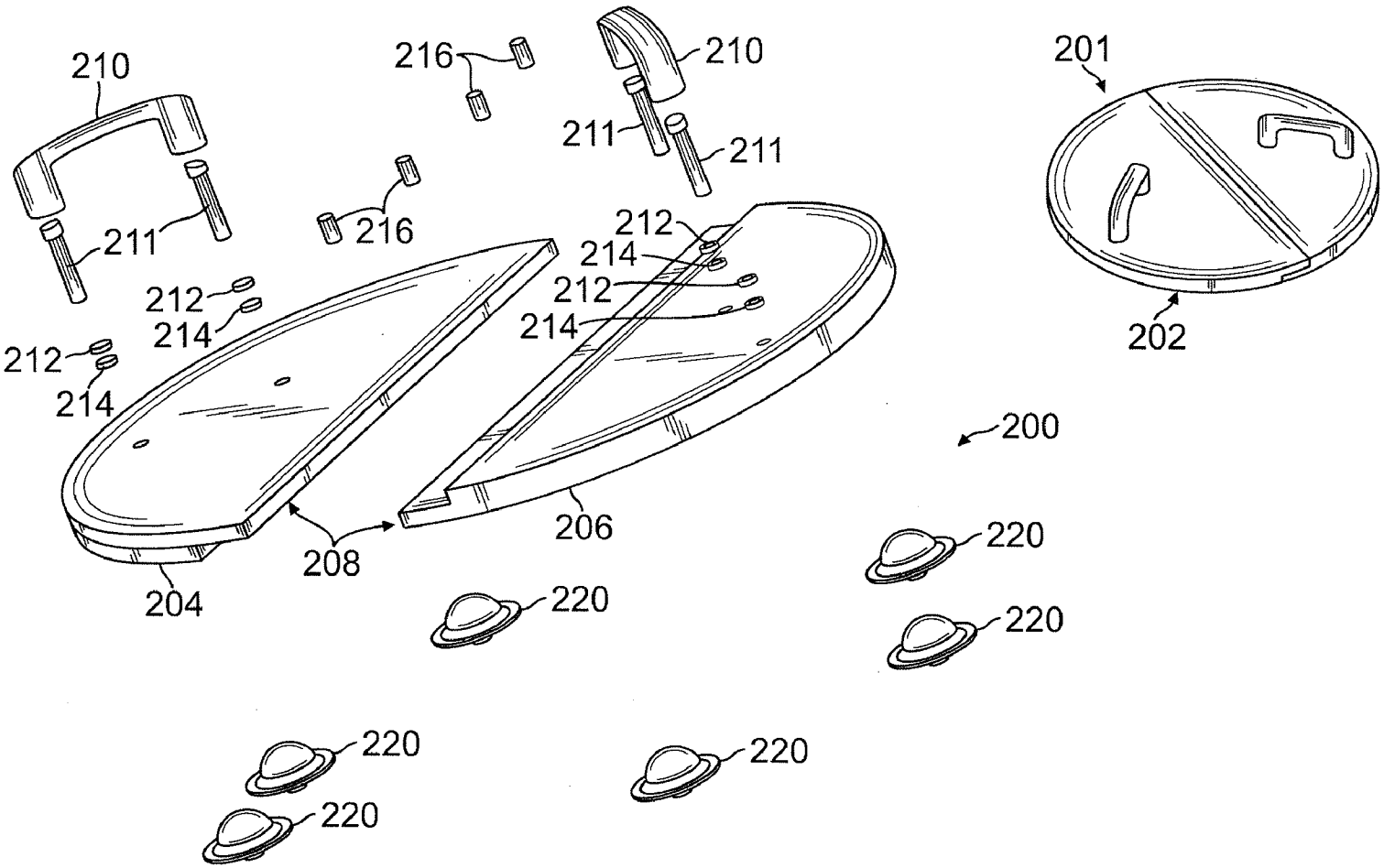
FIG. 3 is a top exploded view of another exemplary implementation of the core strengthening device.
Figure 4:
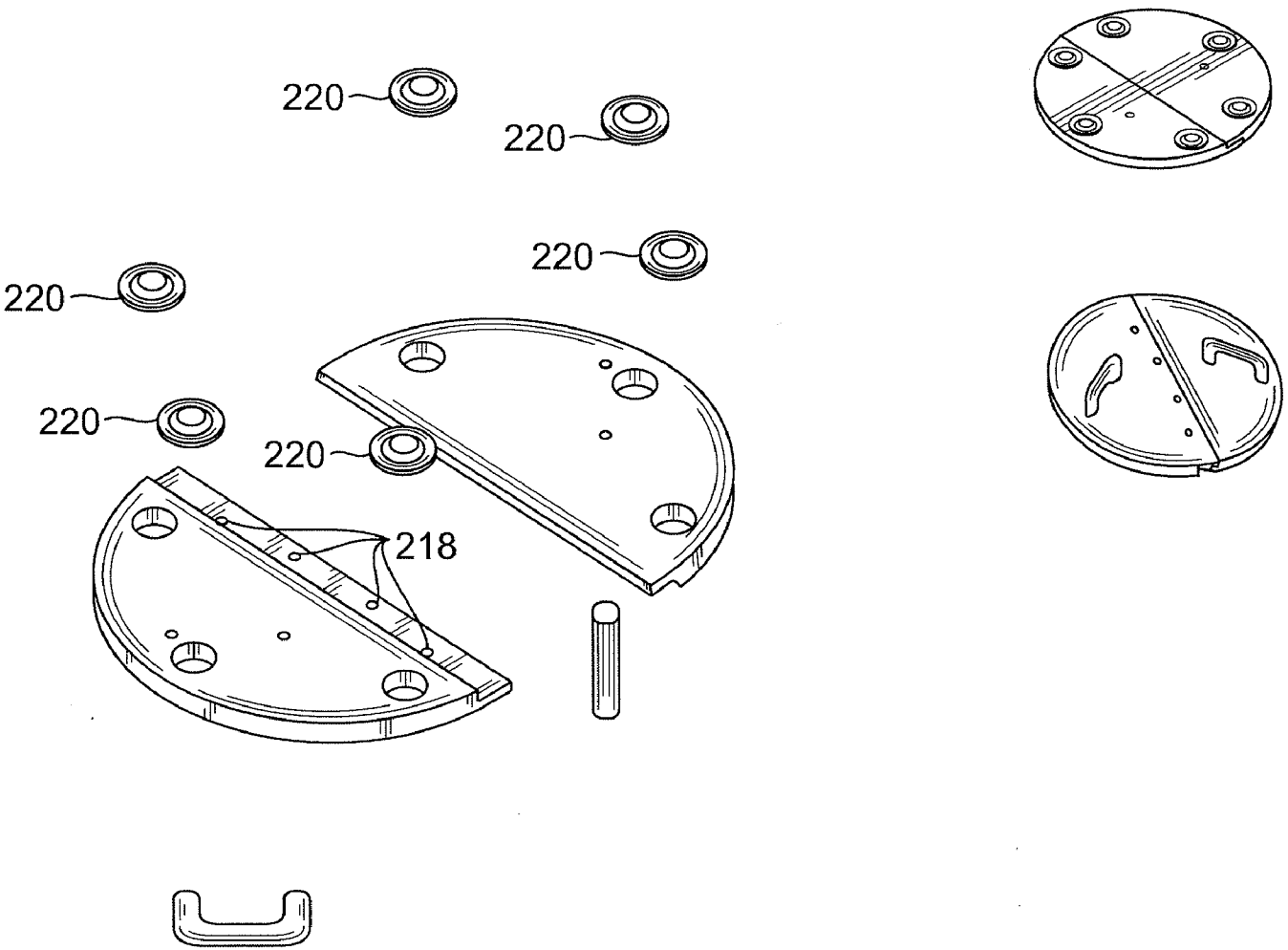
FIG. 4 is a bottom exploded view of the exemplary implementation of the core strengthening device.

FIG. 3 is a top exploded view of another exemplary implementation of a core strengthening device 200, and FIG. 4 is a bottom exploded view of the exemplary implementation of the core strengthening device 200. The device 200 is formed of a base 201 that can be formed as a two-part base by a first base section 204 and a second base section 206, which can be connected together by connection mechanism 208 of each of the first base section 204 and second base section 206. A handle 210 is attached to the top surface of each of the first base section 204 and the second base section 206. The handle 210 can be attached by threaded bolt 211 that is threaded through a locking washer 212 and connected to the respective first base section 204 and second base section 206 by locking nuts 212. A set of connecting rods 216 is attached to an edge region that defines the connecting mechanism one of the first base section 204 or the second base section 206, to extend up therefore. A corresponding set of receptacles 218 is provided to an edge region of the connecting mechanism of the other base section.

Figure 5A:
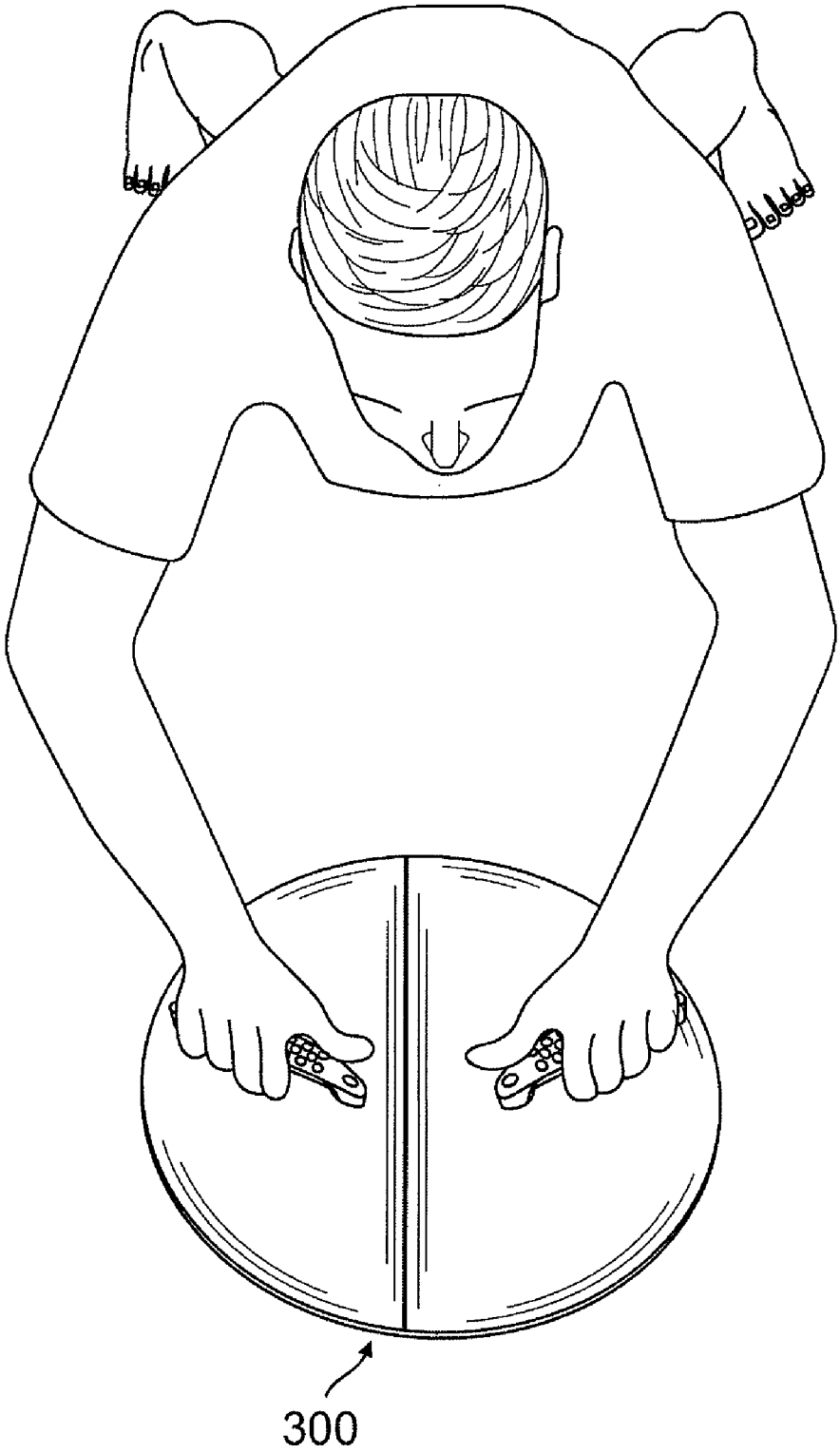
FIGS. 5A-5D illustrate methods of using a core strengthening device.
Figure 5B:
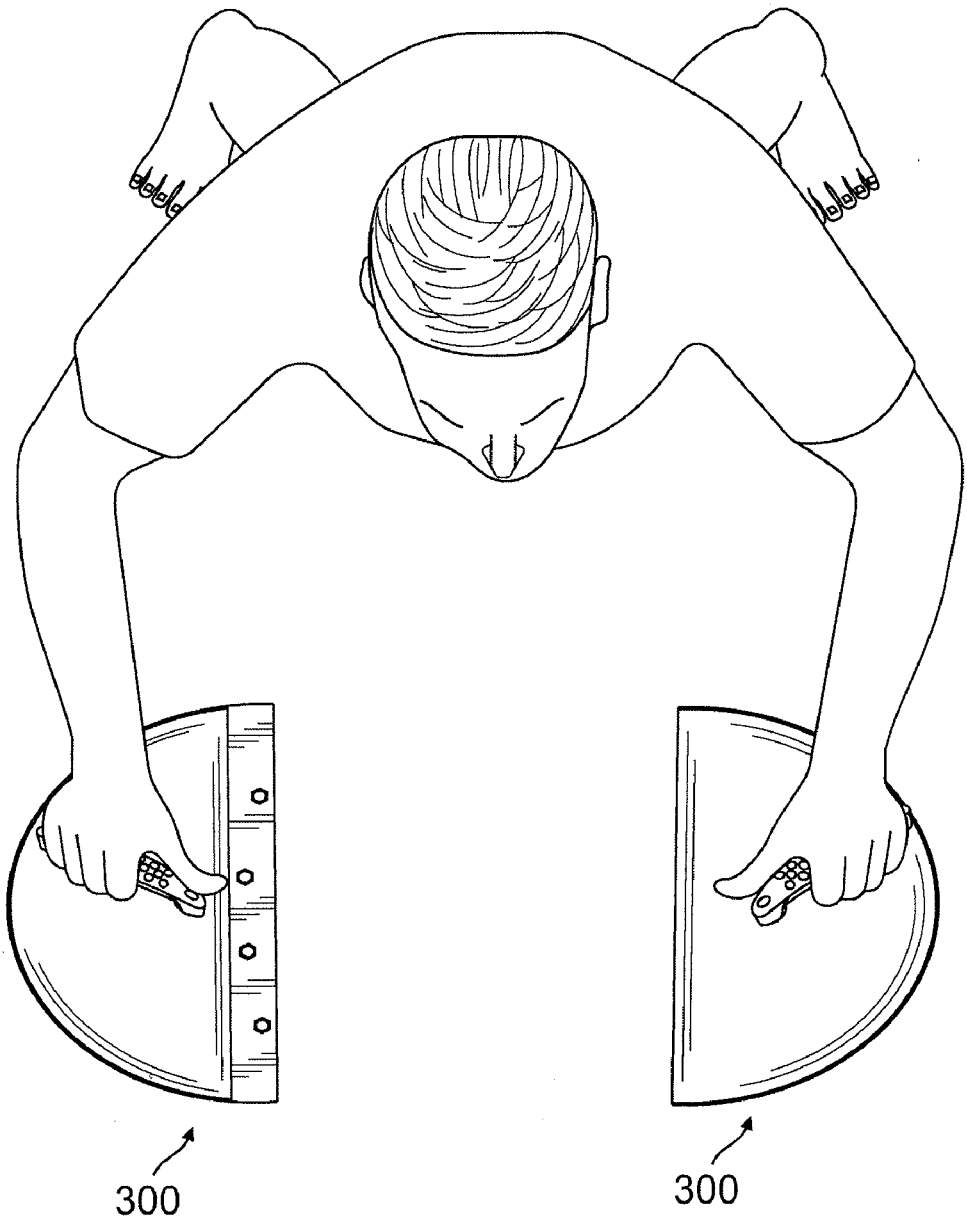
Figure 5C:
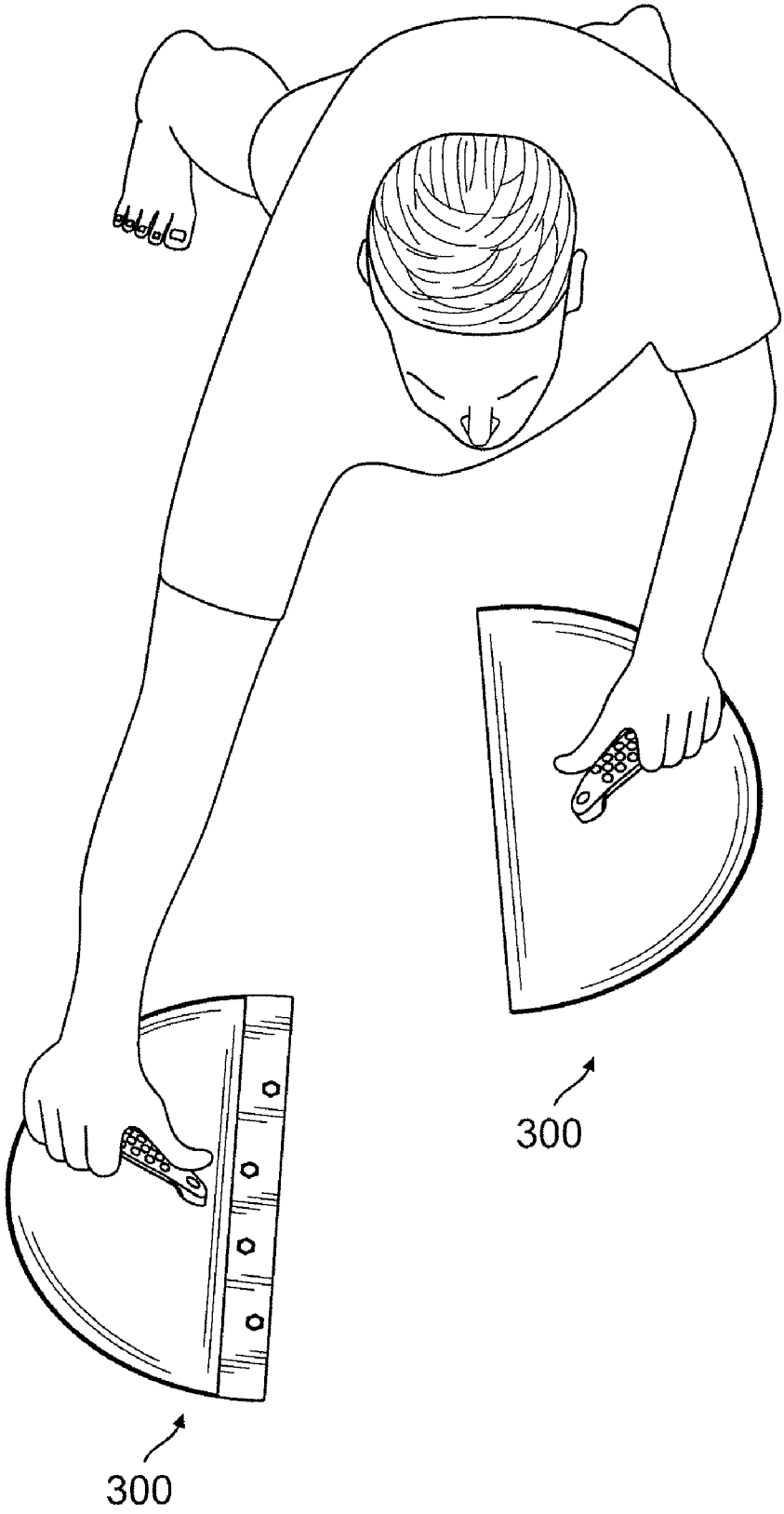
Figure 5D:
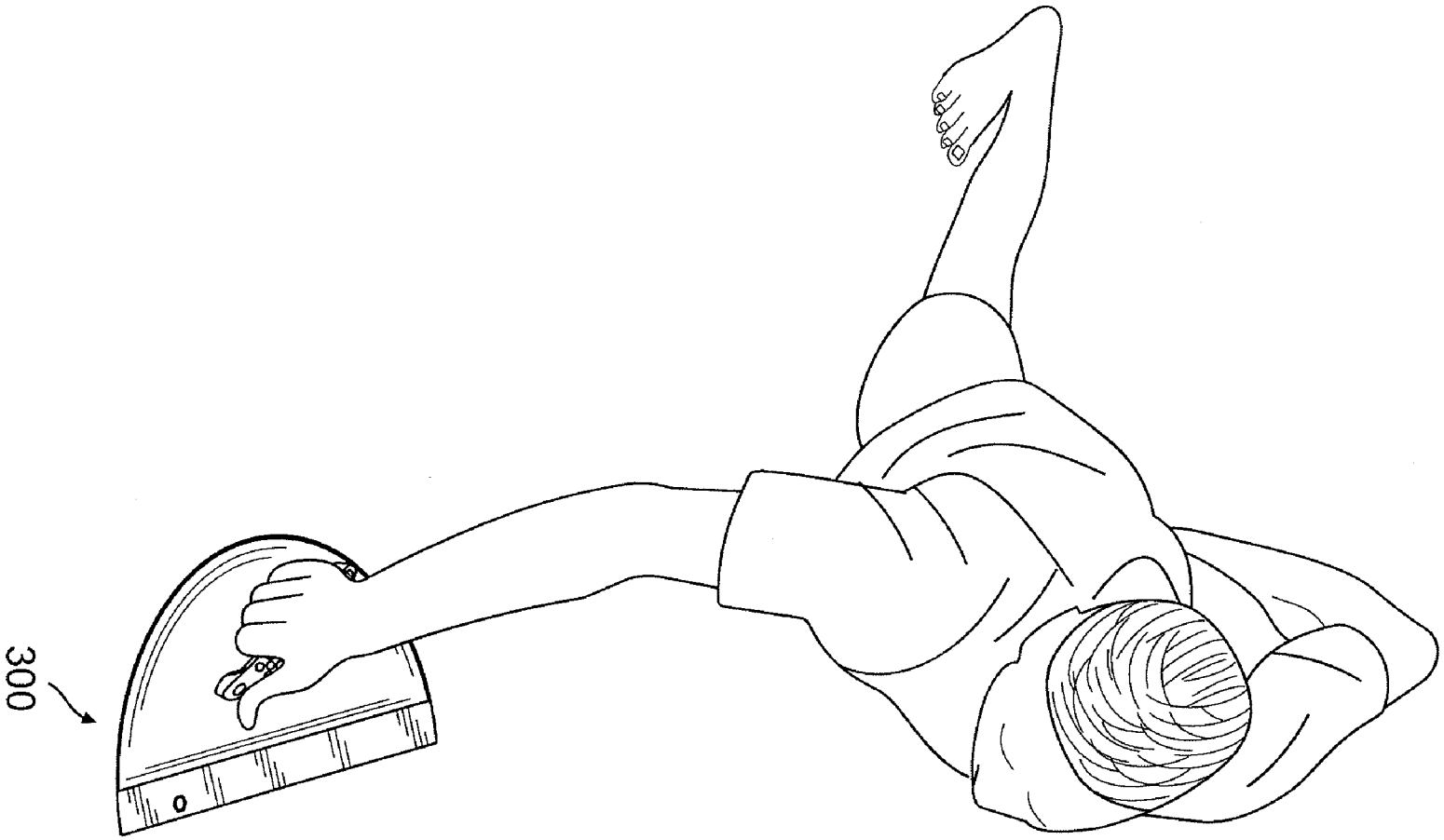

FIGS. 5A-B illustrate methods of using a core strengthening device 300. In operation, a user can kneel or position themselves in a rigid plank position (resting on one's toes holding the device by the handles, as shown in FIGS. 5A-B), and then move the core strengthening device over a surface, either as a unitary device (FIGS. 5A-B) or as separate device sections (FIGS. 5C-D). Movements include side-to-side movement across a user's chest, forward-and-back movement from a user's core toward a point above a user's head, and any number of circular, elliptical or other shapes traced by the movement. The movements can include symmetrical or asymmetrical arm movements.

Although a few embodiments have been described in detail above, other modifications are possible. Other embodiments may be within the scope of the following claims.

The invention claimed is:

1. A core strengthening device comprising:

a base comprising a first base section and a second base section, the first and second base sections each having a connection mechanism that connect together to form a unitary device, the connection mechanism being detachable to separate the first and second base sections to form a two-part device, the connection mechanism comprising the first base section having a male edge region including a plurality of non-aligned connection rods, and the second base section having a female edge region including a plurality of non-aligned receptacles each for receiving one of the connection rods;

a handle connected to a top surface of each of the first and second base sections; and three or more ball transfers connected to a bottom surface of each of the first and second base sections to enable smooth movement over a surface by a user via the handles of the first and second base sections, either as the unitary device or independently as the two-part device.

2. The core strengthening device in accordance with claim 1, wherein each of the ball transfers is formed with a single ball, and wherein the ball is formed of a rigid material that is selected from the group of rigid material that consists of: carbon steel, nylon, stainless steel, ceramic or carbon fiber material.

3. The core strengthening device in accordance with claim 1, wherein the first base section and second base section are formed of a rigid material that is selected from the group of rigid material that consists of: wood, plastic, polyvinyl carbonate, nylon, carbon fiber, or steel.

4. The core strengthening device in accordance with claim 1, wherein the handles further include a soft outer layer.

5. A core strengthening device comprising:

a base that includes a unitary base configuration and a two-part base configuration comprising a first base section and a second base section, the first and second base sections each having a connection mechanism that connect together to form the unitary base configuration, the connection mechanism being detachable to separate the first and second base sections to form the two-part base configuration, the connection mechanism comprising the first base section having a male edge region including a plurality of connection rods, and the second base section having a female edge region including a plurality of receptacles each for receiving one of the connection rods;

a handle connected to a top surface of each of the first and second base sections; and a plurality of ball transfers connected to a bottom surface of each of the first and second base sections to enable smooth movement over a surface by a user via the handles of the first and second base sections, either in the unitary base configuration or independently in the two-part base configuration.

6. The core strengthening device in accordance with claim 5, wherein each of the plurality of ball transfers is formed with a single ball, and wherein the ball is formed of a rigid material that is selected from the group of rigid material that consists of: carbon steel, nylon, stainless steel, ceramic or carbon fiber material.

7. The core strengthening device in accordance with claim 5, wherein the first base section and second base section are formed of a rigid material that is selected from the group of rigid material that consists of: wood, plastic, polyvinyl carbonate, nylon, carbon fiber, or steel.

8. The core strengthening device in accordance with claim 5, wherein the handles further include a soft outer layer.

9. A core strengthening device comprising:

a base that includes a unitary base configuration and a two-part base configuration comprising a first base section and a second base section, the first and second base sections each having a connection mechanism that connect together to form the unitary base configuration, the connection mechanism being detachable to separate the first and second base sections to form the two-part base configuration, the connection mechanism comprising the first base section having a male edge region including a plurality of connection rods, and the second base section having a female edge region including a plurality of receptacles each for receiving one of the connection rods;

a handle connected to a top surface of each of the first and second base sections; and a plurality of casters connected to a bottom surface of each of the first and second base sections to enable smooth movement over a surface by a user via the handles of the first and second base sections, either in the unitary base configuration or independently in the two-part base configuration.

10. The core strengthening device in accordance with claim 9, wherein each of the plurality of casters is formed with one or more wheels, and wherein the wheel is formed of polyurethane.

11. The core strengthening device in accordance with claim 9, wherein the first base section and second base section are formed of a rigid material that is selected from the group of rigid material that consists of: wood, plastic, polyvinyl carbonate, nylon, carbon fiber, or steel.

12. The core strengthening device in accordance with claim 9, wherein the handles further include a soft outer layer.

* * * * *